US010040099B2

(12) United States Patent
Ellehuus

(10) Patent No.: US 10,040,099 B2
(45) Date of Patent: Aug. 7, 2018

(54) SIEVE APPARATUS AND METHOD OF PROVIDING A SANITARY SUPPORT FOR A SCREEN MESH OF A SIEVE APPARATUS

(71) Applicant: GEA Scan-Vibro A/S, Svendborg (DK)

(72) Inventor: Karsten Pedersen Ellehuus, Svendborg (DK)

(73) Assignee: GEA SCAN-VIBRO A/S (SE)

( * ) Notice: Subject to any disclaimer, the term of this patent is extended or adjusted under 35 U.S.C. 154(b) by 0 days.

(21) Appl. No.: 15/510,041

(22) PCT Filed: Sep. 9, 2014

(86) PCT No.: PCT/DK2014/050279

§ 371 (c)(1),
(2) Date: Mar. 9, 2017

(87) PCT Pub. No.: WO2016/037620

PCT Pub. Date: Mar. 17, 2016

(65) Prior Publication Data

US 2017/0297061 A1 Oct. 19, 2017

(51) Int. Cl.
*B07B 1/30* (2006.01)
*B07B 1/50* (2006.01)
(Continued)

(52) U.S. Cl.
CPC ..... *B07B 1/50* (2013.01); *B07B 1/30* (2013.01); *B07B 1/4672* (2013.01); *B07B 1/48* (2013.01)

(58) Field of Classification Search
CPC .... B07B 1/30; B07B 1/48; B07B 1/50; B07B 1/4672
(Continued)

(56) References Cited

U.S. PATENT DOCUMENTS 5,398,816 A * 3/1995 Senapati ..... B01D 33/0376 209/364
8,485,364 B2 * 7/2013 Krush ..... B07B 1/54 209/326
(Continued)

FOREIGN PATENT DOCUMENTS

EP 1 714 709 A1 10/2006
EP 1714709 A1 * 10/2006 ..... B07B 1/06
(Continued)

*Primary Examiner* — Terrell H Matthews
(74) *Attorney, Agent, or Firm* — Condo Roccia Koptiw LLP

(57) ABSTRACT

In a sieve apparatus, a housing (1) is provided with an inlet section with a feed inlet for material to be sifted and a discharge section including at least one outlet. Means are provided for vibrating the screen mesh. The housing has two substantially vertical side walls (2), and a screen mesh (5) having at least one side edge (51) is supported by a support structure (6, 7) connected to the respective side wall (2). The support structure includes a support element (7) along each side wall and adapted to support the screen mesh (5). Each support element is provided as a support profile (7) having an inclined support surface (73) for the side edge (51) of the screen mesh and constituting a V-shaped structure protruding into the housing, said support surface (73) meeting a lower surface (74) in an apex (75) located at a distance from the side wall (2) inside the housing (1). Specifically, each V-shaped support profile (7) is formed as an integral part of the respective side wall (2).

18 Claims, 5 Drawing Sheets

(51) Int. Cl.
*B07B 1/48* (2006.01)
*B07B 1/46* (2006.01)

(58) Field of Classification Search
USPC ..... 209/342
See application file for complete search history.

(56) References Cited

U.S. PATENT DOCUMENTS

| | | | | |
|---|---|---|---|---|
| 8,714,363 | B2 * | 5/2014 | Bezuidenhout | B29B 13/10 209/241 |
| 2005/0072717 | A1 * | 4/2005 | Purohit | B07B 1/36 209/309 |
| 2013/0068667 | A1 * | 3/2013 | Bezuidenhout | B29B 13/10 209/247 |
| 2017/0297061 | A1 * | 10/2017 | Ellehuus | B07B 1/50 |

FOREIGN PATENT DOCUMENTS

| | | | | |
|---|---|---|---|---|
| EP | 1714709 | A1 * | 10/2006 | B07B 1/06 |
| GB | 554 679 | A | 7/1943 | |
| WO | WO 03/013690 | A1 | 2/2003 | |
| WO | WO 2009/046071 | A2 | 4/2009 | |
| WO | WO 2009046071 | A2 * | 4/2009 | B07B 1/46 |
| WO | WO-2009046071 | A2 * | 4/2009 | B07B 1/46 |

* cited by examiner

SIEVE APPARATUS AND METHOD OF PROVIDING A SANITARY SUPPORT FOR A SCREEN MESH OF A SIEVE APPARATUS

CROSS REFERENCE TO RELATED APPLICATIONS

This application is the National Stage Entry under 35 U.S.C. § 371 of Patent Cooperation Treaty Application No. PCT/DK2014/050279, filed 9 Sept. 2014 the contents of which are hereby incorporated by reference herein.

FIELD OF THE INVENTION

The present invention relates to a sieve apparatus comprising a housing having an inlet section with a feed inlet for material to be sifted and a discharge section including at least one outlet, at least one substantially vertical side wall, a screen mesh having at least one side edge, means for vibrating the screen mesh, and a support structure connected to the respective side wall including at least one support element along each side wall and adapted to support the screen mesh. The invention furthermore relates to a method of providing a sanitary support for a screen mesh in a sieve apparatus.

BACKGROUND OF THE INVENTION

Sieve apparatus of this kind, also referred to as vibrating screen sifters, are well known in the art for separating and classifying material into at least two size-fractions by allowing the smaller fraction of the feed material to sift through the screen mesh.

Some apparatus make use of multiple vibrating screens, with a top screen separating the largest or over-size material from the rest of the material, which in turn falls onto an intermediate screen. The intermediate screen mesh then separates an intermediate size of material from undersize material. Other apparatus may consist of two or more housings connected to each other sequentially for retrieving material of different size configurations.

In for instance the food and pharma sectors, hygiene is an increasingly important area of focus when sifting powder or particulate material in a sieve apparatus of this kind. Hence, efficient cleaning is required. Cleaning In Place (CIP) is one approach to cleaning, and for several reasons it is becoming increasingly popular, as the CIP procedure allows for cleaning without handling of heavy screen meshes, possibly with sharp edges, which are furthermore easily damaged.

In order for the sieve apparatus to be able to be cleaned by CIP methods, demands are made to the configuration of the support structure of the screen mesh. In one commonly known solution the screen mesh is supported by a rectangular fixed bar mounted on the side wall. The bar provides a sealing functionality preventing unscreened material to find its way around the screen mesh and into the material of smaller size. However, in addition to difficulties in reaching all areas during the cleaning procedure, the bar can carry finished product all the way to the exit without letting it through the screen mesh. This constitutes a waste and production loss. In a second known solution an elastomer element with packing lip, for instance made of silicone and mounted along the edge of the screen mesh in which case the side wall of the housing is even and without support bars. In the opening between the screen mesh and the silicone edge element, there are obviously potentially severe hygiene challenges. Furthermore, the elastomer edges cannot withstand the chemicals used in CIP cleaning, and break-down after only a few CIP procedures is not uncommon. In order to avoid the critical hygiene problems related to the two above-mentioned, known technologies, a third known solution is today usually used for CIP sieve apparatus. Here, the supporting bars and the seal element are simply removed. Even though this results in a CIP cleanable construction, this solution entails other disadvantages, the main problem being that due to production tolerances of screen mesh as well as the side walls a small gap between the screen mesh and the side wall cannot be eliminated, which in turn allows unsorted material to find its way around the mesh, resulting in residual material in the finished product.

SUMMARY OF THE INVENTION

On this background, it is an object of the present invention to provide a sieve apparatus, by which the above disadvantages are alleviated and in which sanitary cleaning may be carried out.

In a first aspect, this and further objects are met by a sieve apparatus of the kind mentioned in the introduction, which is furthermore characterized in that each support element is provided as a support profile having an inclined support surface for the side edge of the screen mesh and constituting a substantially V-shaped structure protruding into the housing, said support surface meeting a lower surface in an apex located at a distance from the side wall inside the housing.

By the provision of such a V-shaped support profile, a self-adjusting abutment between the screen mesh and the support profile is achieved, hence resulting in a structure that does not allow residual to bypass the screen mesh and it does not allow finished material to be passed through the apparatus as production loss, but without the use of elastomer materials that cannot be properly cleaned. Furthermore, the V-shape provides for easy access to all areas to be cleaned during the CIP procedure.

The term "substantially V-shaped", or simply "V-shaped", is to be understood as encompassing structures having rounded edges or corners at the bends of the V, for instance at the apex and at the transition to the side wall.

In a preferred embodiment, the V-shaped support profile is formed as an integral part of the side wall. Such a one-piece structure entails that no joints are present in which material may gather and which are difficult to clean.

However, in an alternative embodiment it is conceivable to form the V-shaped support profile as a separate element connected to the side wall.

In principle, the support surface of the V-shape extending between a first point at the side wall and the apex could have any suitable inclination to provide appropriate support and still fulfil the requirements to easy access and cleanability, for instance an inclination in the range 20° to 70° with the horizontal. However, it is preferred that the inclination lie in the range 30° to 60°, and most preferred 40° to 50°. In a presently preferred embodiment, the V-shape corresponds to an isosceles triangle having an apex angle of substantially 90°, the support surface having an inclination of substantially 45°. This provides for a reliable support in combination with easy access to all areas.

In a second aspect, a method of providing a sanitary support for a screen mesh in a sieve apparatus is provided.

In preferred developments of the method, each V-shaped support profile is formed as an integral part of the respective side wall, and it is preferred that each side wall of the housing is formed by sheet metal and the V-shaped support profile is provided in a sheet forming process such as bending or rolling.

Further details and advantages appear from the remaining dependent claims, and from the detailed description of preferred embodiments and examples for carrying out the method set forth below.

DETAILED DESCRIPTION OF THE INVENTION AND OF PREFERRED EMBODIMENTS

Figure 1:
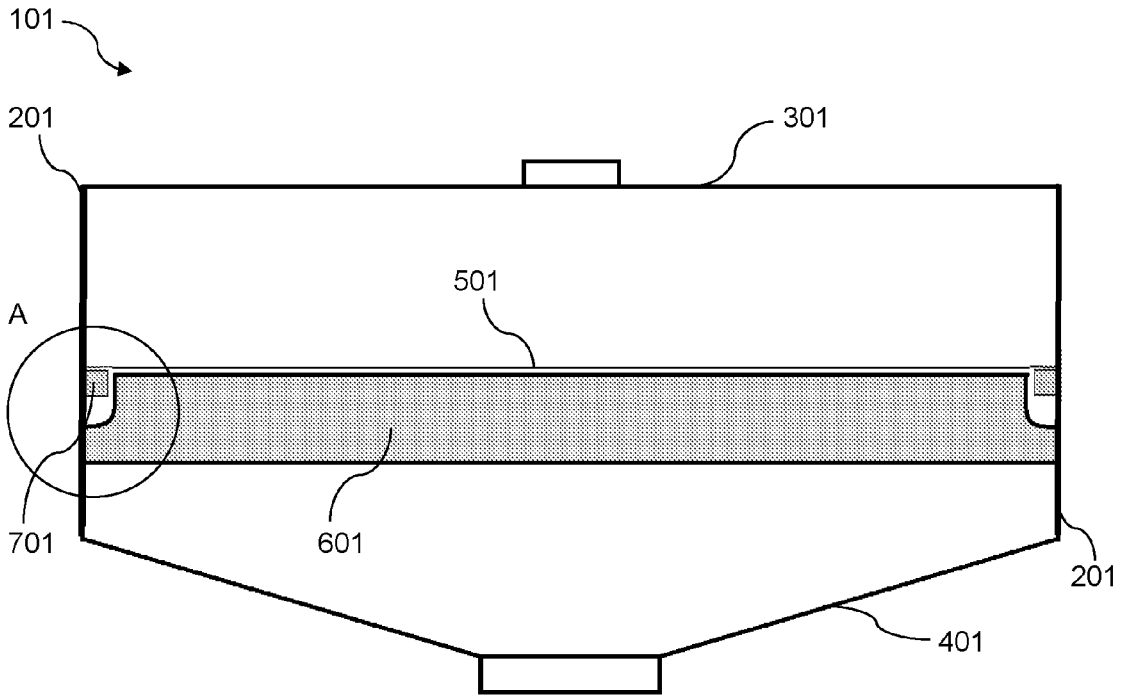
Fig. 1 (PRIOR ART)
FIG. 1 is a schematic cross-sectional view of a prior art sieve apparatus.
Figure 2:
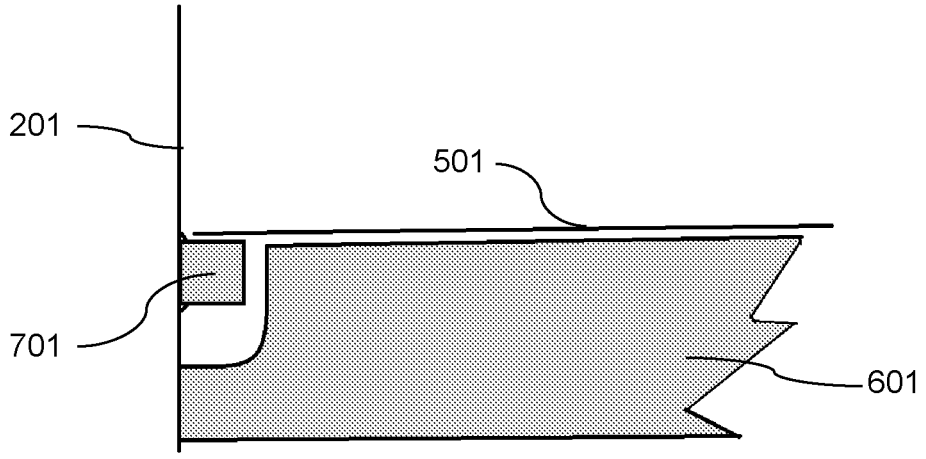
Fig. 2 (PRIOR ART)
FIG. 2 is a partial view of detail A of the prior art sieve apparatus of FIG. 1, on a larger scale.

In FIG. 1, a prior art sieve apparatus is shown represented by its housing 101 and which in a customary manner is provided with an inlet section with a feed inlet for material to be sifted and a discharge section including at least one outlet, and means for vibrating the screen mesh, these parts being not shown. The housing has two opposing and substantially vertical side walls 201, a top wall 301 and a bottom wall 401. In the housing 101, a screen mesh 501 is supported by a number of transverse ribs 601 and a support element 701. Reference is then made to FIG. 2, showing detail A of FIG. 1. In this commonly known solution, the support element 701 is a rectangular fixed bar mounted on the side wall 201, typically by means of welding.

Figure 3:
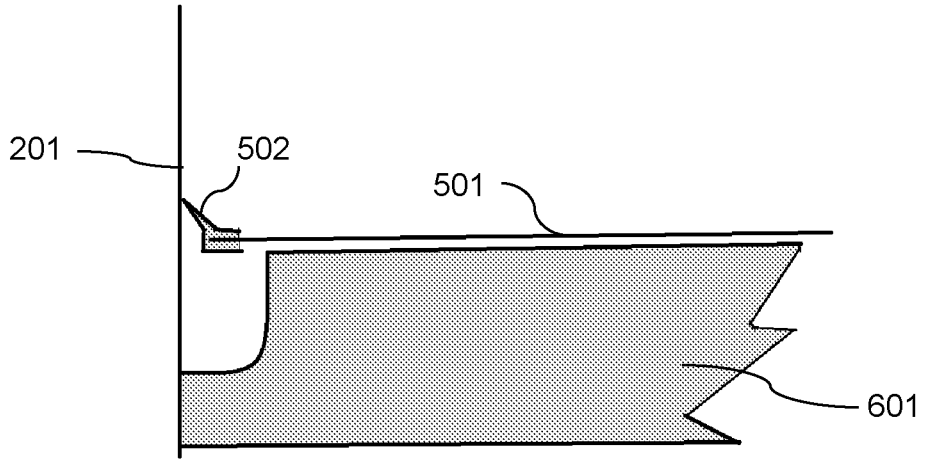
Fig. 3 (PRIOR ART)
FIGS. 3 and 4 are views corresponding to FIG. 2 of details of further prior art apparatus.
Figure 4:
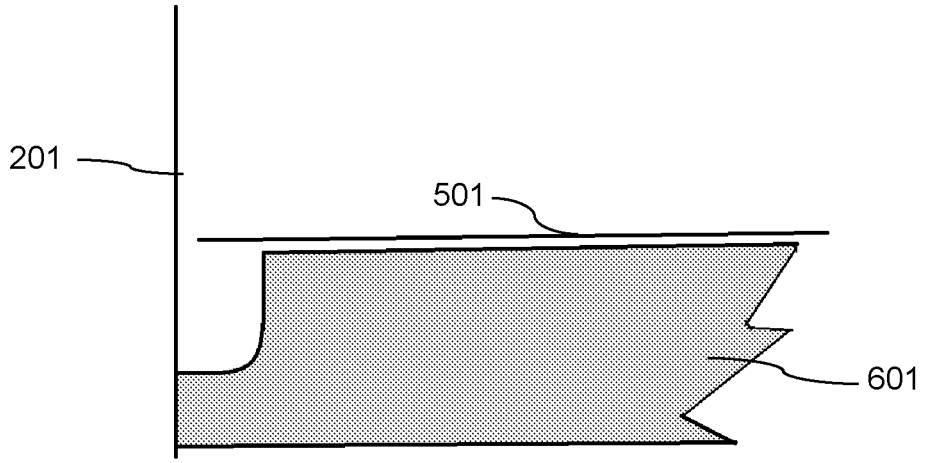
Fig. 4 (PRIOR ART)
Figure 5:
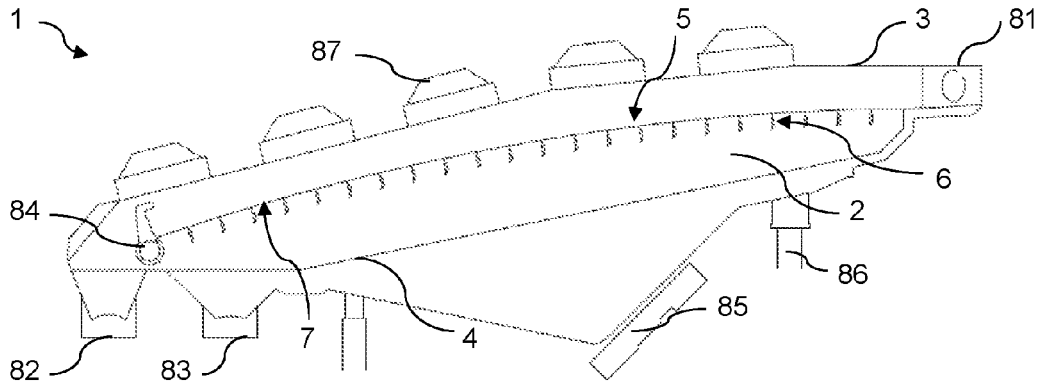
FIG. 5 is a side view of a sieve apparatus in a first embodiment of the invention.

Alternative known solutions are shown in FIGS. 3 and 4, in which the second solution shown in FIG. 3 makes use of an elastomer element with packing lip 502, for instance made of silicone and mounted along the edge of the screen mesh 501, and in the third solution of FIG. 4, the screen mesh 501 is supported only by the transverse ribs 601.

Referring now to FIGS. 5 to 7 and 10 showing a first embodiment of the invention, the sieve apparatus comprises a housing 1 having an inlet section with a feed inlet 81 for material to be sifted and a discharge section including at least one outlet 82, 83, and at least one substantially vertical side wall 2. In the embodiment shown, the housing 2 has a generally rectangular configuration as seen from above, and two opposing side walls 2 are present. The housing thus defines a general longitudinal direction between the inlet section and the outlet section. A screen mesh 5 having a longitudinal extension and supported by a support structure 6,7 to be described in further detail is present in the housing 2. The sieve apparatus furthermore comprises means 85 for vibrating the screen mesh, here a motor providing a well-defined frequency. Further details shown in FIG. 5 include means 84 for tightening the screen mesh 5 in the longitudinal direction, parts of a carrying structure 86 including spring means for the vibration function (not shown), and inspection covers 87.

During operation, the sieve apparatus is vibrated, usually to produce a slow forward movement and a rapid rearward movement, so that material present on the screen mesh will move forward with the screen but, due to inertia will permit the screen to move rearwardly under it. As a result, the material will work its way forwardly on the respective screen, so that material which does not fall through the screen will be discharged from the discharge end of the respective screen, for collection.

The support structure comprises a set of transverse ribs 6 extending substantially perpendicularly to the side walls 2, located below the screen mesh 5. The transverse ribs 6 are connected to the side walls 2 in that the respective ends (not shown) are introduced through apertures in the side walls. In use, the screen mesh 5 lies on top of the transverse ribs 6. By forming the ribs 6 at varying height position along the length of the housing 2, the desired course of the screen mesh 5 is defined. Furthermore, the support structure comprises a support element along each side wall 2 to support a respective side edge 51 of the screen mesh 5. According to the invention, the support element is provided as a support profile 7 having an inclined support surface 73 for the side edge 51 of the screen mesh and constituting a substantially V-shaped structure protruding into the housing, said support surface 73 meeting a lower surface 74 in an apex 75 located at a distance from the side wall 2 inside the housing 1. Each transverse rib 6 has an upper edge 61 substantially at the level of the respective apex 75 of the V-shaped support profile.

In the first embodiment, each V-shaped support profile 7 is formed as an integral part of the respective side wall 2.

The support surface 73 of the V-shape extends between a first point 71 at the side wall 2 and the apex 75 and has an inclination in the range 20° to 70° with the horizontal, preferably 30° to 60°, most preferred 40° to 50°. Specifically, in the first embodiment the V-shape corresponds to an isosceles triangle having an apex angle of substantially 90°, the support surface 73 having an inclination of substantially 45°, just as the lower surface 74. This allows for easy access to the transitions between the side wall 2 and the V-shaped support profile 7 at first and second points 71, 72, respectively, and hence all areas are able to be properly cleaned. In the drawings, the V-shape is shown having sharp edges for illustrating purposes solely. It is to be understood that the term "substantially V-shaped", or simply "V-shaped", encompasses structures having rounded edges or corners at the bends of the V, in the first embodiment for instance at the apex and at the points of transition to the side wall. In the first embodiment, each side wall of the housing is formed by sheet metal and the V-shaped support profile is provided in a sheet forming process such as bending or rolling, which in itself renders the edges and corners rounded.

Figure 6:
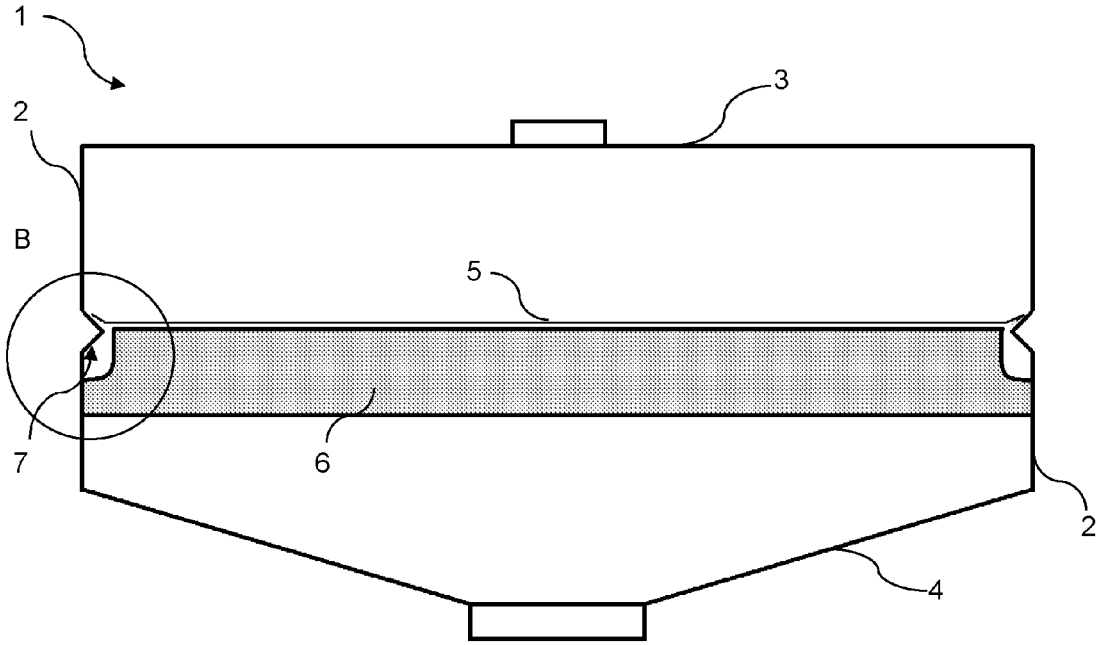
FIG. 6 is a schematic cross-sectional view corresponding to FIG. 1, but of the sieve apparatus in the embodiment of FIG. 5.
Figure 7:
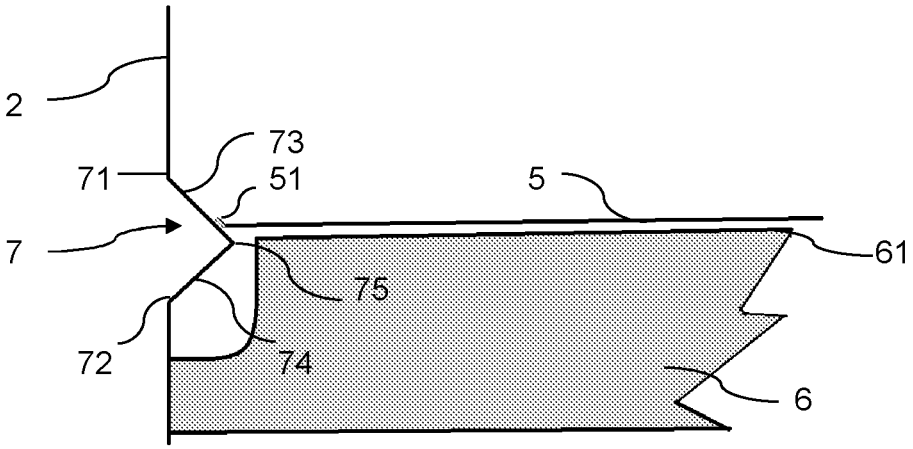
FIG. 7 is a partial schematic view of detail B of the sieve apparatus of FIGS. 5 and 6, on a larger scale.
Figure 10:
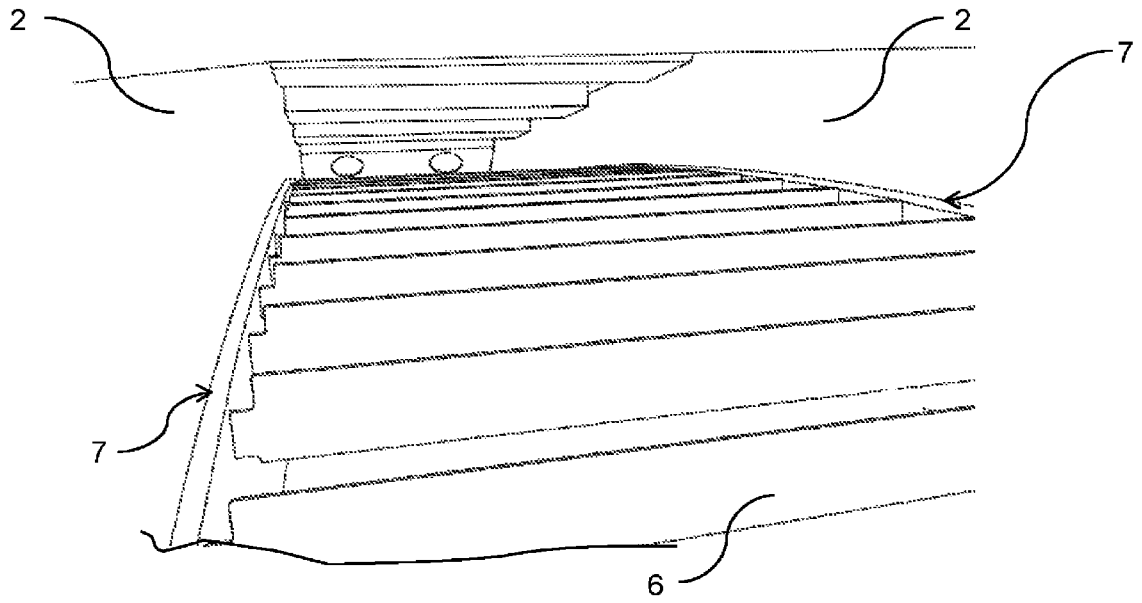
FIG. 10 is a perspective view showing parts of the interior of the sieve apparatus in the first embodiment shown in FIGS. 5 to 7.

Referring again to FIG. 5, it is seen that the contours of the V-shaped support profile 7 are visible from the outer side of the side wall of the housing in the embodiment of FIGS. 5-7 and 10. Here, it is also shown that the V-shaped support profile 7 forms a substantially arc-shaped course along the side wall 2.

Figure 8:
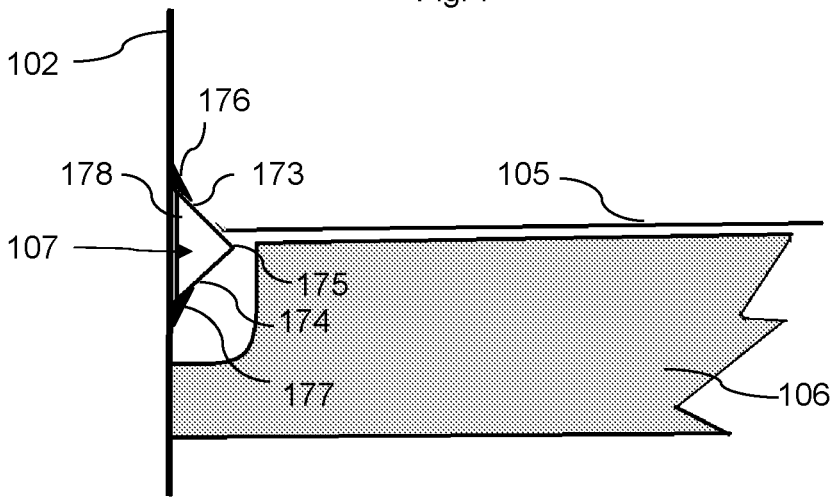
FIGS. 8 and 9 are schematic views corresponding to FIG. 7 of a second and a third embodiment of the invention, respectively.
Figure 9:
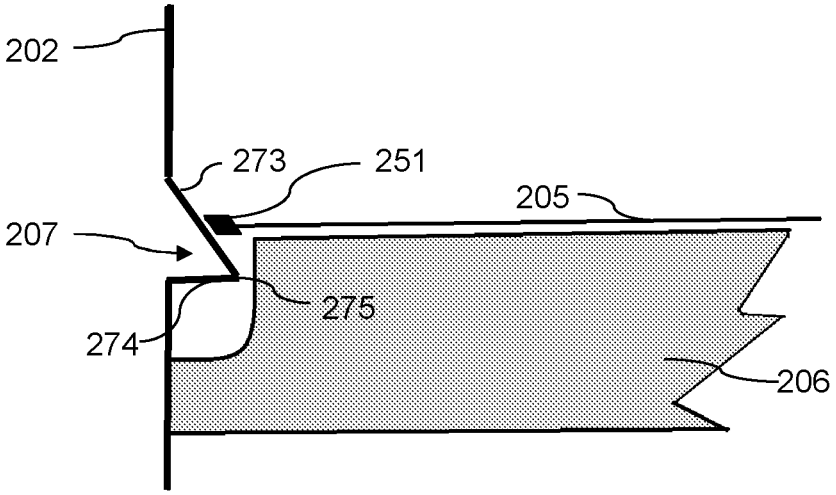

In the alternative, second and third embodiments shown in FIGS. 8 and 9, elements having the same or analogous function are denoted by the same reference numerals to which 100 and 200, respectively, has been added. Only differences relative to the first embodiment will be described in detail.

In the embodiment of FIG. 8 each V-shaped support profile 107 is formed as a separate element connected to the respective side wall 102. The support profile comprises an inclined support surface 173, a lower surface and here a base surface 178 in contact with the side wall 102. The support profile 107 is connected to the side wall 102 in two weldings 176 and 177.

Alternative connections are conceivable, for instance mechanical fastening means such as a screw or bolt may be introduced from the outside and into a threaded hole or bushing.

In the embodiment of FIG. 9, two variations to the first embodiment are present:

The side edge of the screen mesh 205 is provided with a frame element 251. The frame element 251 is made from any suitable material and is preferably flexible and resilient. The connection to the screen mesh is carried out by pressing, gluing, moulding, welding, or soldering. Such a frame element could also be applied to the first and second embodiments.

The inclination of the support surface 273 forms an angle of approximately 60° with the horizontal and the lower surface 274 is substantially horizontal, is perpendicular to the side wall 202. This configuration is less preferred than the first configuration, as the relatively steep angle of the support surface 273 gives a smaller abutment face of the screen mesh 205, and at the sharp edge at the transition between the side wall 202 and the lower surface 274, there is a risk of crack formation, which in addition to weakening the material is prone to undesired gathering of material.

The material and the dimensions of the sieve apparatus depend on the field of use.

In the above-mentioned embodiments, the housing and the V-shaped support profiles are made from a metal material such as steel.

Alternative designs include sieve apparatus wherein the housing and the V-shaped support profiles are made from a composite or plastic, possibly thermoplastic, material.

In the above embodiments, the support profile has been shown and described as a single coherent profile at each wall. However, as an alternative, each V-shaped support profile may be composed of a number of elements, possible separated by a gap between each other.

The dimensions of the sieve apparatus in the actual embodiment are such that the internal width between the two opposing side walls is approximately 1.3 m. The length of the entire sieve apparatus is about 6 m, and the length of the screen mesh is about 5 m. The apex of the V-shaped support profile 7 in the first embodiment protrudes approximately 2 cm into the housing 2. For other screen meshes, this dimension may be larger or smaller. The size is chosen in accordance with the materials of other parts, for instance stainless steel has a tendency to deform during the welding of the various parts, in turn entailing larger manufacturing tolerances.

In the following, a method of providing a sanitary support for a screen mesh in a sieve apparatus will be described. The method comprises the steps of:

providing a housing with an inlet section with a feed inlet for material to be sifted and a discharge section including at least one outlet, and at least one substantially vertical side walls, providing a screen mesh with two side edges, providing each side wall with a support profile having an inclined support surface and constituting a V-shaped structure protruding into the housing, said support surface meeting a lower surface in an apex located at a distance from the side wall inside the housing, and placing the screen mesh on the inclined support surface of the respective V-shaped support profile.

In the preferred embodiment, each V-shaped support profile is formed as an integral part of the respective side wall. Furthermore, each side wall of the housing is formed by sheet metal and the V-shaped support profile is provided in a sheet forming process such as bending or rolling.

Alternatively, each side wall of the housing is formed by a composite or plastic, possibly thermoplastic, material and the V-shaped support profile is formed by moulding. As a further alternative, each side wall of the housing is formed by a workpiece of surplus thickness and each V-shaped support profile is provided by cutting the workpiece in a milling process.

In the event each V-shaped support profile is formed as a separate element which is connected to the respective side wall, it may be either welded to the side wall, or connected to the side wall by adhesion.

The invention should not be regarded as being limited to the embodiments shown and described in the above. Several modifications and combinations are conceivable within the scope of the appended claims. Although the invention has been described with reference to a sieve apparatus having a substantially rectangular configuration, the underlying principle is applicable to apparatus having other configurations such as for instance circular.

The invention claimed is:

1. A sieve apparatus comprising:

a housing having an inlet section with a feed inlet for material to be sifted and a discharge section including at least one outlet, at least one substantially vertical side wall, a screen mesh having at least one side edge and a longitudinal extension between the inlet section and the discharge section in the housing, means for tightening the screen mesh in a longitudinal direction, means for vibrating the screen mesh, and a support structure formed as an integral part of a respective side wall including at least one support element along each side wall and adapted to support the screen mesh, wherein each support element is provided as a support profile having an inclined support surface for the side edge of the screen mesh and constituting a substantially V-shaped structure protruding into the housing, the support surface meeting a lower surface in an apex located at a distance from the respective side wall inside the housing, and wherein each V-shaped support profile is formed as an integral part of the respective side wall and forms a substantially arc-shaped course along the respective side wall.

2. A sieve apparatus according to claim 1, wherein the support surface of the V-shape extending between a first point at the side wall and the apex has an inclination in the range 20° to 70° with the horizontal, preferably 30° to 60° , or more preferably 40° to 50°.

3. A sieve apparatus according to claim 2, wherein the V-shape corresponds to an isosceles triangle having an apex angle of substantially 90°, the support surface having an inclination of substantially 45°.

4. A sieve apparatus according to claim 1, wherein contours of the V-shaped support profile are visible from an outer side of the side wall of the housing.

5. A sieve apparatus according to claim 1, wherein the at least one side edge of the screen mesh is provided with a frame element, the frame element being preferably flexible and resilient, and preferably connected to the screen mesh by pressing, gluing, moulding, welding, or soldering.

6. A sieve apparatus according to claim 1, wherein the housing and the V-shaped support profiles are made from a metal material such as steel.

7. A sieve apparatus according to claim 1, wherein the housing and the V-shaped support profiles are made from a composite or plastic, possibly thermoplastic, material.

8. A sieve apparatus according to claim 1, wherein the support structure further comprises a set of transverse ribs extending substantially perpendicularly to the respective side wall, located below the screen mesh and having an upper edge substantially at a level of the respective apex of the V-shaped support profile.

9. A sieve apparatus according to claim 1, wherein each V-shaped support profile is composed of a number of elements, separated by a gap between each other.

10. A method of providing a sanitary support for a screen mesh in a sieve apparatus comprising:

providing a housing with an inlet section with a feed inlet for material to be sifted and a discharge section including at least one outlet, and at least one substantially vertical side wall, providing a screen mesh with two side edges and a longitudinal extension between the inlet section and the discharge section in the housing, tightening the screen mesh in a longitudinal direction, providing each side wall with a support profile having an inclined support surface and constituting a V-shaped structure protruding into the housing with each V-shaped support profile formed as an integral part of a respective side wall and forming a substantially arc-shaped course along the respective side wall, wherein the support surface meeting a lower surface in an apex located at a distance from the respective side wall inside the housing, and placing the screen mesh on the inclined support surface of the respective V-shaped support profile.

11. The method of claim 10, wherein each side wall of the housing is formed by sheet metal and the V-shaped support profile is provided in a sheet forming process such as bending or rolling.

12. The method of claim 10, wherein each side wall of the housing is formed by a composite or plastic, such as thermoplastic, material and the V-shaped support profile is formed by moulding.

13. The method of claim 10, wherein each side wall of the housing is formed by a workpiece of surplus thickness and each V-shaped support profile is provided by cutting the workpiece in a milling process.

14. The method of claim 10, wherein each V-shaped support profile is formed as a separate element which is connected to the respective side wall.

15. The method of claim 11, wherein the sheet forming process leaves contours of the V-shaped support profile visible from an outer side of the respective side wall of the housing.

16. A sieve apparatus comprising:

a housing having an inlet section with a feed inlet for material to be sifted and a discharge section including at least one outlet, at least one substantially vertical side wall, a screen mesh having at least one side edge and a longitudinal extension between the inlet section and the discharge section in the housing, a tightener configured to tighten the screen mesh in a longitudinal direction, a motor configured to vibrate the screen mesh, and a support structure formed as an integral part of a respective side wall including at least one support element along each side wall and adapted to support the screen mesh, where each support element is provided as a support profile having an inclined support surface for the side edge of the screen mesh and constituting a substantially V-shaped structure protruding into the housing, the support surface meeting a lower surface in an apex located at a distance from the side wall inside the housing, wherein each V-shaped support profile is formed as an integral part of the respective side wall and forms a substantially arc-shaped course along the respective side wall.

17. A sieve apparatus according to claim 16, wherein the support surface of the V-shape extending between a first point at the side wall and the apex has an inclination in the range 20° to 70° with the horizontal, preferably 30° to 60°, or more preferably 40° to 50°.

18. A sieve apparatus according to claim 17, wherein the V-shape corresponds to an isosceles triangle having an apex angle of substantially 90°, the support surface having an inclination of substantially 45°.

* * * * *